US007905620B2

(12) United States Patent
Harris

(10) Patent No.: US 7,905,620 B2
(45) **Date of Patent: *Mar. 15, 2011**

(54) ELECTRICAL SYSTEM FOR HELMETS AND HELMETS SO EQUIPPED

(75) Inventor: Kerry Harris, San Antonio, TX (US)

(73) Assignee: Shabaka, LLC, New City, NY (US)

( * ) Notice: Subject to any disclaimer, the term of this patent is extended or adjusted under 35 U.S.C. 154(b) by 128 days.

This patent is subject to a terminal disclaimer.

(21) Appl. No.: 11/527,788

(22) Filed: Sep. 26, 2006

(65) Prior Publication Data

US 2007/0019399 A1 Jan. 25, 2007

Related U.S. Application Data

(63) Continuation-in-part of application No. 11/040,974, filed on Jan. 21, 2005, now Pat. No. 7,303,302.

(60) Provisional application No. 60/544,687, filed on Feb. 17, 2004.

(51) Int. Cl.
*F21V 21/084* (2006.01)

(52) U.S. Cl. ..... 362/105; 362/106; 362/103; 362/183; 362/570

(58) Field of Classification Search ..... 362/105, 362/106, 103, 183, 570; 2/906, 209.13; 455/575.2
See application file for complete search history.

(56) References Cited

U.S. PATENT DOCUMENTS

| | | | | |
|---|---|---|---|---|
| 3,108,862 | A | 10/1963 | Toulmin | |
| 3,391,407 | A | 7/1968 | Waters | |
| 4,498,202 | A | 2/1985 | Yamamoto | |
| 4,858,627 | A | 8/1989 | Netschert | |
| 4,982,452 | A * | 1/1991 | Chaise | 2/421 |
| 5,034,747 | A | 7/1991 | Donahue | |
| 5,327,587 | A * | 7/1994 | Hurwitz | 2/422 |
| 5,758,947 | A * | 6/1998 | Glatt | 362/105 |
| 5,810,467 | A | 9/1998 | Hurwitz | |
| 5,871,271 | A * | 2/1999 | Chien | 362/106 |
| 6,009,563 | A * | 1/2000 | Swanson et al. | 2/425 |
| 6,017,049 | A | 1/2000 | Spector | |
| 6,113,243 | A | 9/2000 | Saul | |
| 6,406,168 | B1 * | 6/2002 | Whiting | 362/473 |
| 6,474,816 | B2 * | 11/2002 | Butler et al. | 351/221 |
| 6,598,236 | B1 | 7/2003 | Gantt | |
| 6,730,047 | B2 | 5/2004 | Socci et al. | |
| 6,760,925 | B1 | 7/2004 | Maxwell | |
| 6,784,795 | B1 | 8/2004 | Pories et al. | |
| 6,966,668 | B2 | 11/2005 | Cugini et al. | |
| 6,970,691 | B2 | 11/2005 | Thompson | |
| 7,075,250 | B2 | 7/2006 | Colwell | |
| 7,080,414 | B1 | 7/2006 | Montero et al. | |
| 7,303,302 | B2 | 12/2007 | Harris | |
| 7,369,174 | B2 | 5/2008 | Olita et al. | |
| 2004/0025230 | A1 | 2/2004 | Rainey | |
| 2004/0171969 | A1 | 9/2004 | Socci et al. | |
| 2004/0225236 | A1 | 11/2004 | Wheeler et al. | |
| 2005/0096096 | A1 | 5/2005 | Birli et al. | |
| 2010/0063652 | A1 | 3/2010 | Anderson | |

OTHER PUBLICATIONS

International Search Report for International Application No. PCT/US2007/020453.

* cited by examiner

*Primary Examiner* — Sandra L O Shea
*Assistant Examiner* — Danielle Allen
(74) *Attorney, Agent, or Firm* — TraskBritt

(57) ABSTRACT

An electrical power system is described, including a distribution system configured to supply electrical power to a bicycle helmet system and a power source configured to supply power to one or more elements associated with the bicycle helmet system using the distribution system, the power source being housed within a protective element of a bicycle helmet.

17 Claims, 10 Drawing Sheets

ELECTRICAL SYSTEM FOR HELMETS AND HELMETS SO EQUIPPED

CROSS REFERENCE TO RELATED APPLICATIONS

This application is a continuation-in-part of U.S. patent application Ser. No. 11/040,974 filed Jan. 21, 2005 entitled "Electrical Power System to Crash Helmets," now U.S. Pat. No. 7,033,302 issued Dec. 4, 2007, which is incorporated herein by reference for all purposes and claims priority to U.S. Provisional Patent Application No. 60/544,687 entitled "Helmet Power System" filed Feb. 17, 2004 which is incorporated herein by reference for all purposes. This application is also related to U.S. Pat. No. 7,530,704, issued May 12, 2009, to U.S. patent application Ser. No. 11/981,848 filed Oct. 30, 2007, now abandoned, and to U.S. patent application Ser. No. 12/418,157 filed Apr. 3, 2009, pending. This application is also related to U.S. patent application Ser. No. 11/974,500, filed on Oct. 11, 2007, now U.S. Pat. No. 7,530, 704, issued May 12, 2009.

FIELD OF THE INVENTION

The present invention relates generally to safety equipment. Specifically, an electrical power system for crash helmets is described.

BACKGROUND OF THE INVENTION

Crash helmets ("helmets") are used for a variety of purposes, providing cranial and neck safety protection for users in industries such as sports and leisure, equipment and vehicle operation, construction, military, law enforcement, and others. Helmets offer basic protection of head and neck areas, providing hard surfaces to deflect impacts from physical force or traumas that could cause temporary or permanent physical injury. Helmets can also provide other features beyond basic protection.

Conventional helmets may offer features such as heads-up displays, optical or aural protection, lighting, and communication systems. However, conventional helmet systems often require power sources or supplies that may be heavy or externally coupled to a helmet. Conventional helmets also require significant user interaction in order to activate or deactivate a feature. Equipment such as batteries, power cells, processors, communication transceivers, night/low vision goggle or visor systems can be implemented but require external electrical power supplies and electrical connections to a power supply. The external connections and power supplies are often bulky, difficult to use, and vulnerable to damage. Additionally, external components may require significant user interaction in order to attach and use the feature, creating a potential safety risk. For example, a motorcycle police officer attempting to activate and hold an external flash light while handling a notepad or other equipment exposes the officer to potential harm while preoccupied with activating his light. Military personnel using a heads-up display or night/low-vision system with their helmet while maneuvering through difficult terrain may risk damage or vulnerability due to external wires and power supplies inhibiting movement.

Thus, what is needed is a solution for electrical power for crash helmets and related systems without the limitations of conventional techniques.

BRIEF DESCRIPTION OF THE DRAWINGS

Various embodiments of the invention are disclosed in the following detailed description and the accompanying drawings.

DETAILED DESCRIPTION OF THE PREFERRED EMBODIMENTS

Implementation of described techniques may occur in numerous ways, including as a system, device, apparatus, process, a computer readable medium such as a computer readable storage medium, or a computer network wherein program instructions are sent over optical or electronic communication links.

A detailed description of one or more embodiments is provided below along with accompanying figures that illustrate the principles of the embodiments. The scope of the embodiments is limited only by the claims and encompasses numerous alternatives, modifications and equivalents. Numerous specific details are set forth in the following description. These details are provided solely for the purposes of example and the embodiments may be practiced according to the claims without some or all of these specific details.

Electrical power systems for crash helmets are described. Various devices, components, and systems using electrical power may be implemented. In keeping with various embodiments described herein, electrical power may be supplied from a power cell or battery to different devices, systems, or components integrated with a helmet. These devices, systems, or components may be manually or automatically activated using a switch coupled to a power cell using various electrical leads, wires or connectors ("leads"). By implementing an electrical power system in a helmet, external power sources and the need for external attachments or hardware are eliminated, enabling features or enhancements to be coupled to a helmet while using power drawn from a helmet electrical power supply.

Figure 1:
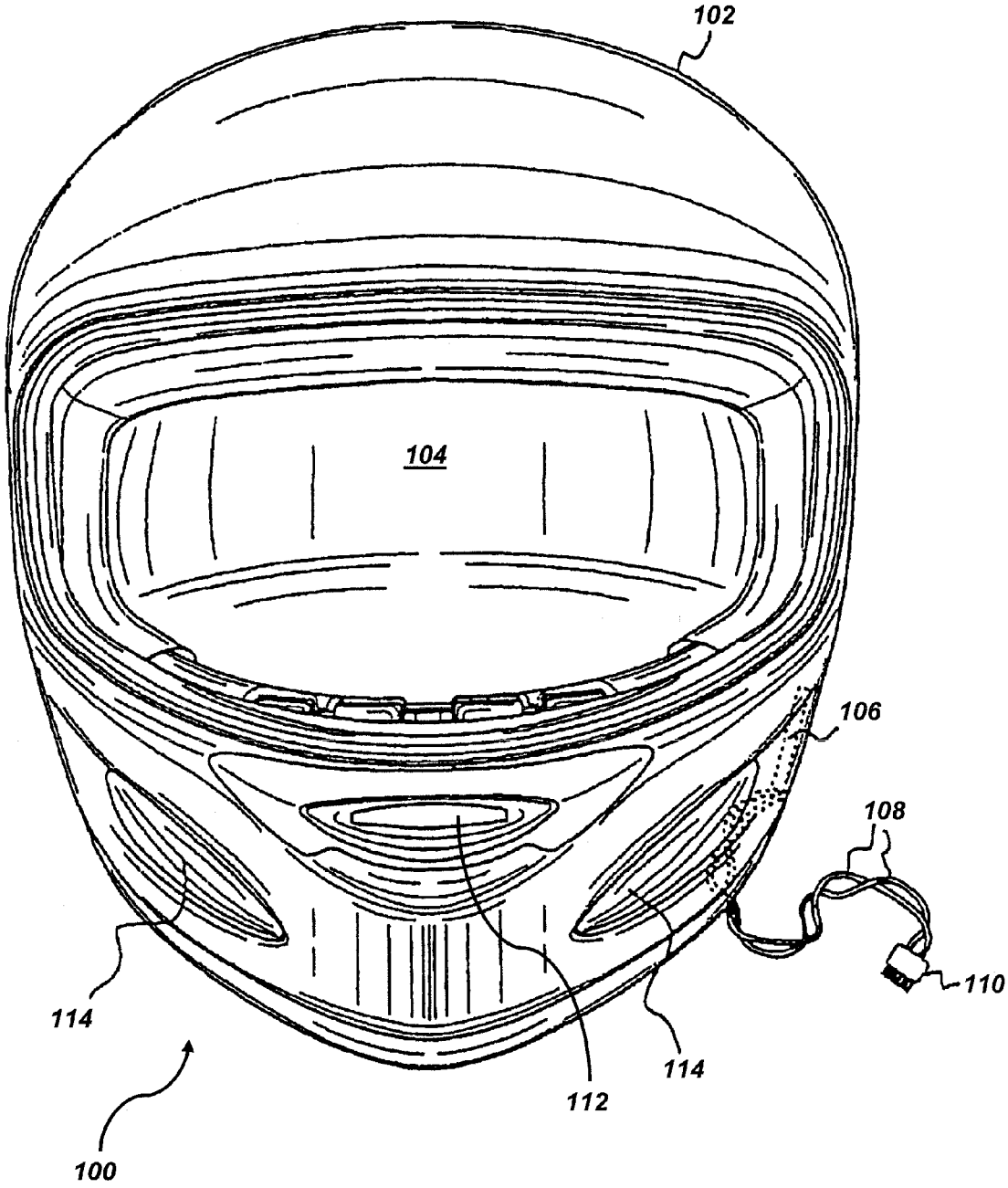
FIG. 1 illustrates an exemplary electrical power system for a crash helmet.

FIG. 1 illustrates an exemplary electrical power system for a crash helmet. Here, helmet 100 is shown including shell 102, visor 104, power cell 106, electrical leads 108, connector 110, vent 112, and side vents 114. In some embodiments, shell 102 may be implemented using materials such as plastic, metal, metal alloys, composite materials (e.g., KEVLAR®), or other materials that provide impact-resistant strength. Also, power cell 106 may be implemented as a single power cell or as a series of power cells (i.e., a battery), which may be used to store a DC charge when charged by, for example, an AC (e.g., 110 V, 60 Hz) or DC (e.g., 12V) power source. Power distribution from power cell 106 may also be implemented by conducting current along electrical leads 108. Electrical leads 108 may be implemented using copper, steel, various metal alloys, or other types of electrically conductive materials. In some embodiments, power cell 106 may also include components such as a processor, switch, a ventilation fan and motor, and other electrical or electronic devices. In other embodiments, power cell 106 may be implemented using various types of batteries (e.g., lithium ion, nickel cadmium, nickel metal hydroxide, and others). Additionally, connector 110 may be used to couple, either directly or indirectly, power cell 106 to an external charger or power inverter. A power charge or inverter may be used to build, store, or discharge electrical energy stored in power cell 106. An electrical charge may be provided from power cell 106 along electrical leads 108 to various components, or systems. Although not shown, an electrical switch (e.g., contact, pressure, mechanical, electromechanical, or others) may be used to allow electrical current to flow from power cell 106 to other systems. Additionally, power cell 106 may be coupled to other systems attached, coupled, connected, or formed in shell 102. In some embodiments, features, enhancements, or other systems providing lighting, communication, or information may be provided in other parts of helmet 100.

Figure 2:
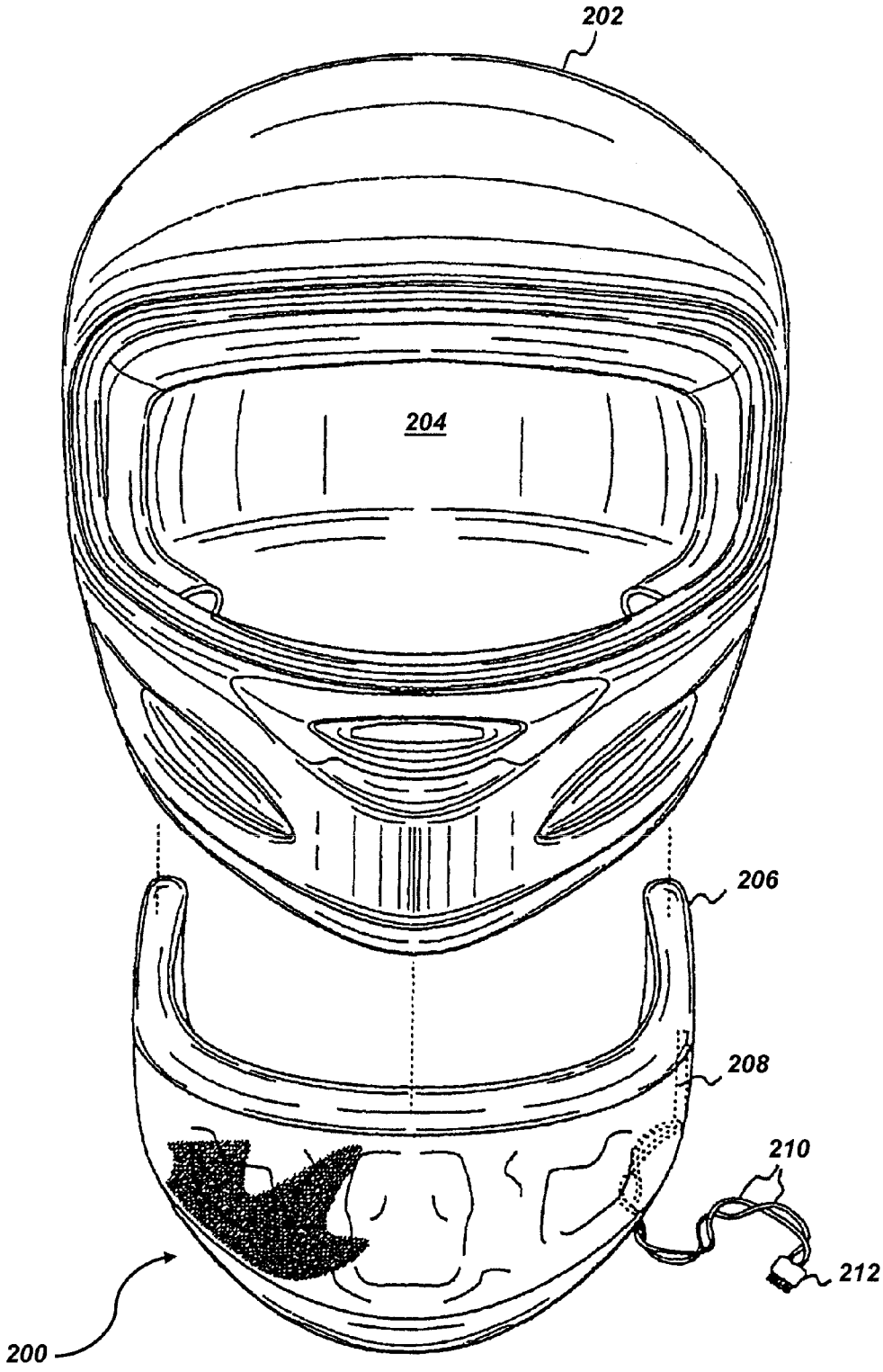
FIG. 2 illustrates an exemplary electrical power system for a crash helmet including a chinbar.

FIG. 2 illustrates an exemplary electrical power system for a crash helmet including a chinbar. In some embodiments, helmet 200 includes shell 202, visor 204, chinbar 206, power cell 208, electrical leads 210, and connector 212. Here, chinbar 206 may be implemented using various materials such as polystyrene, injection molded plastic, or other plastic compounds of varying stiffness material rigidity. Chinbar 206 may also be implemented as a single piece or as multiple pieces and are not limited to the examples described herein. Modifications to chinbar 206 may be implemented using alternative materials and configurations other than those discussed herein. For example, different materials, shapes, material compositions, configurations, components, and other modifications may be implemented. As an example, chinbar 206 may include power cell 208 and electrical leads 210 secured within an internal cavity or pocket. As part of chinbar 206, an exemplary electrical power system such as those described herein may be implemented to provide electrical power to other components attached, connected, or coupled to helmet 200 without requiring an external source of power or leads. Further, the need for wiring, mounting, and mounting hardware for coupling an external power source are eliminated. Additionally, numerous components may be operated using power delivered by an electrical current from power cell 208. Some components may include one or more ventilation fans, heads-up display, lighting, communication systems (e.g., BLUETOOTH®, IEEE 802.11 standard-based wireless communications modules and components), and others.

Figure 3A:
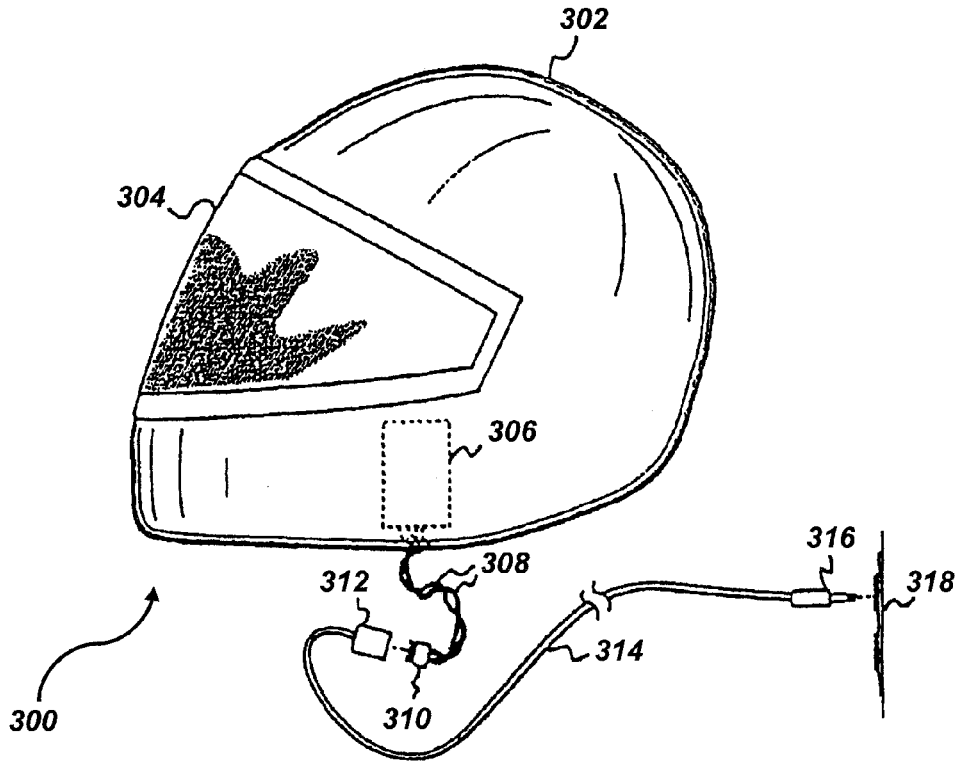
FIG. 3A illustrates an exemplary electrical power system for a crash helmet coupled to a power supply.

FIG. 3A illustrates an exemplary electrical power system for a crash helmet coupled to a power supply. In some embodiments, helmet 300 may be implemented using shell 302, visor 304, power cell 306, electrical leads 308, connectors 310 and 312, supply lead 314, plug 316, and power outlet 318. Here, power cell 306 may be charged and re-charged by plugging into a DC or AC power supply, power inverter, charger, or other device such as power outlet 318. In some embodiments, power outlet 318 may be a portable or installed power source. In other embodiments, power outlet 318 may be implemented differently.

Here, electrical current charges power cell 306, which may used to provide an electrical current to other devices, systems, or components in helmet 300. Although not shown, other devices, systems, or components such as fans, fan motors, processors and microprocessors, display systems, and the like may be included. Connectors 310 and 312 provide a connection between power cell 306 and power outlet 318, enabling electrical current to flow between components located at various endpoints of an electrical system embedded in a helmet. In some embodiments, connectors 310 and 312 may be implemented using female-male connectors, snap, mechanical, or other types of connectors. When connector 310 is not coupled to connector 312, connector 310 may be inserted or tucked into a pocket, cavity, or other restraining structure within chinbar or cheek pad (not shown) to prevent it from catching on any passing obstructions. Alternatively, electrical leads 308 and connector 310 may be detached from power cell 306 and stored separately. In other embodiments, electrical leads 308 and connector 310 may be attached to another device, system, or component in helmet 300.

Figure 3B:
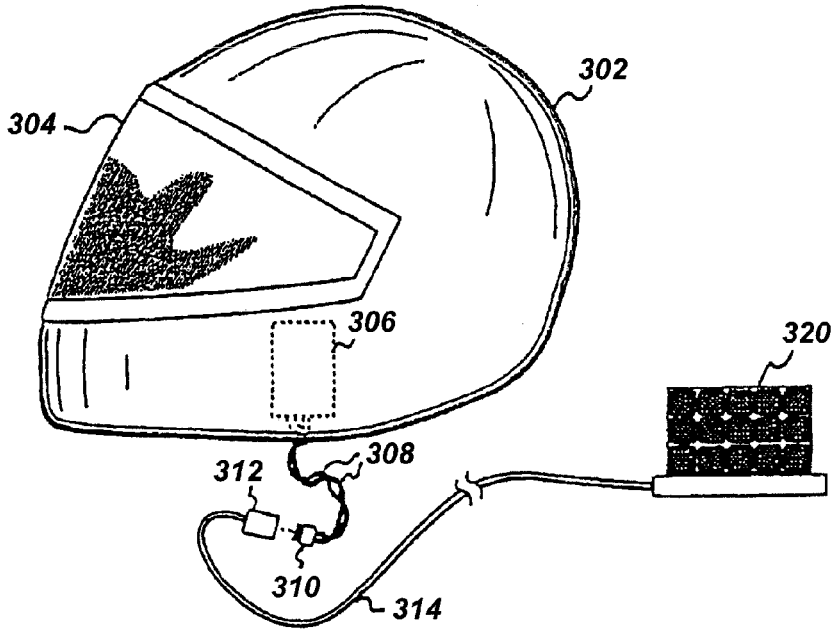
FIG. 3B illustrates an exemplary power system for a crash helmet coupled to an alternative power supply.

FIG. 3B illustrates an exemplary power system for a crash helmet coupled to an alternative power supply. Here, helmet 300 includes shell 302, visor 304, power supply 306, electrical leads 308, connectors 310 and 312, supply lead 314, and charger 320. In some embodiments, charger 320 may be used to provide a DC voltage to charge or recharge power cell 306. Charger 320 may be implemented as a single cell or multiple cell battery (e.g., LiOH, NiMH, NiCD, and others), as a solar charger, power inverter, or as another AC/DC charger. In some embodiments, supply lead 314 may be detachable or hard-wired into charger 320. If hard-wired, charger 320 may be remotely, but proximally, located to helmet 300. For example, helmet 300 may be worn by a motorcyclist while charger 320 may be physically located elsewhere on a suit worn by the motorcyclist or on the motorcycle. If a solar charger is used, charger 320 may be worn on an external surface of helmet 300, converting solar energy to electrical energy to provide a constant charge to power cell 306. In some embodiments, charger 320 may be a motorcycle battery (e.g., 12V DC) that, when connected via connectors 310 and 312, supplies an electrical current to charge or recharge power cell 306.

Figure 4:
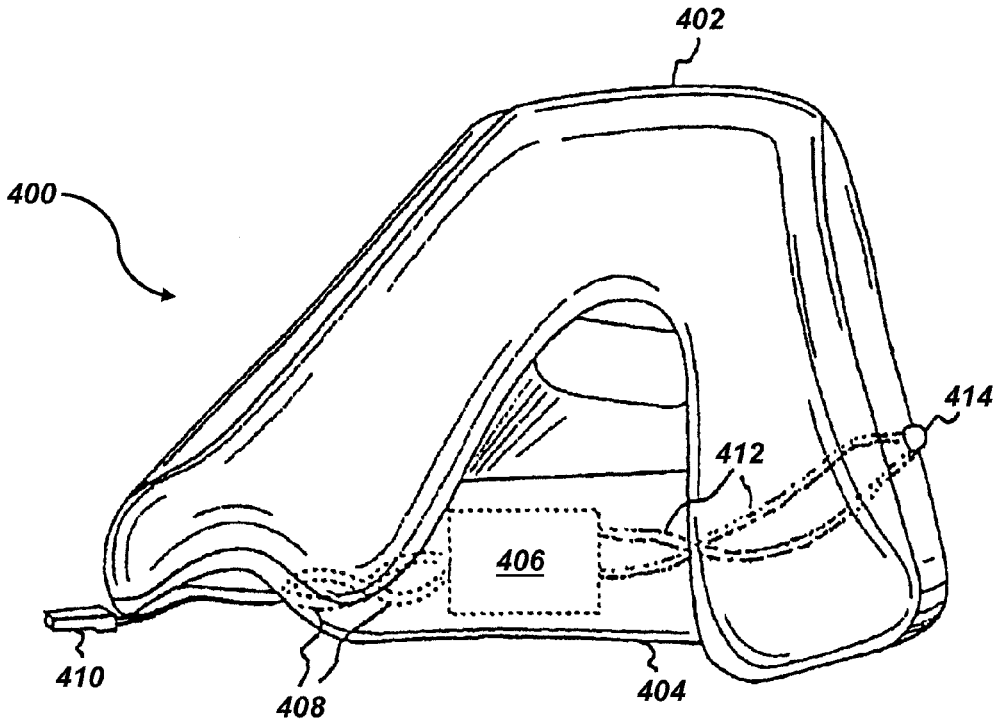
FIG. 4 illustrates an exemplary electrical power system insert for a crash helmet.

FIG. 4 illustrates an exemplary electrical power system insert for a crash helmet. Here, system 400 includes pad 402, which has cheekpad 404, power cell 406, electrical leads 408, connector 410, output leads 412, and light 414. In some embodiments, pad 402 may be fitted for half or three-quarter (¾) helmets with no chinbar. If no chinbar is included, power cell 406 may be integrated, secured within, or formed into cheekpad 404. In other embodiments, cheekpad 404 may be manufactured with a hollow pocket having an opening for inserting power cell 406 inside. The elasticity of material used to implement cheekpad 404 may be high enough to permit the opening to be stretched to allow the passage of power cell 406 to the cavity formed within cheekpad 404. In other embodiments, power cell 406 may be inserted before, during, or after manufacturing pad 402 and cheekpad 404. In still other embodiments, power cell 406 may be implemented differently.

In some embodiments, power cell 406 may be used to provide electrical current to additional devices, systems, or components included with the electrical power system. For example, light 414 may be powered using an electrical DC voltage provided by power cell 406. Power cell 406 may be a single or multiple cell battery storing an electrochemical charge that, when output, provides a DC voltage to light 414. In some embodiments, light 414 may be implemented as an incandescent, light-emitting diode, or other light-emitting device. A switch (not shown) disposed between power cell 406 and light 414 may provide a user with the ability to control the light (i.e., activate, deactivate). In other embodiments, light 414 may be replaced or supplemented with other components such as a power- or voice-activated wireless transmission system for cellular or mobile phone communications, short-range RF transceivers, camera or imaging device, display (e.g., heads-up display), or other electrically powered devices.

Figure 5:
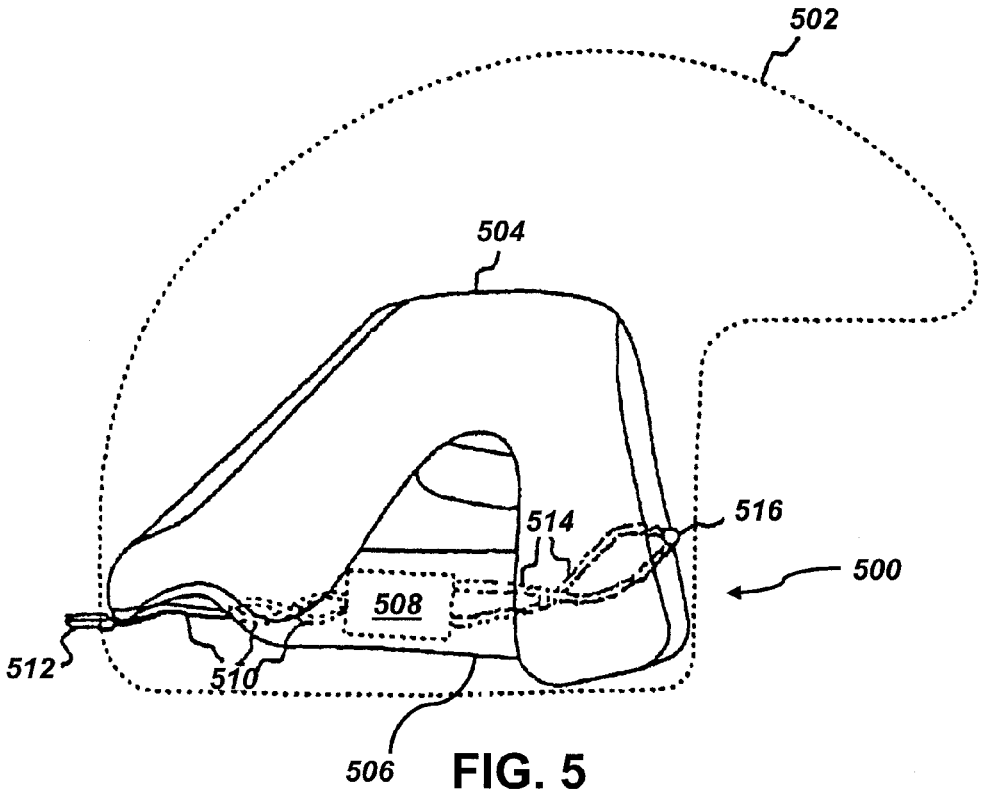
FIG. 5 illustrates an alternative exemplary electrical power system for a crash helmet.

FIG. 5 illustrates an alternative exemplary electrical power system for a crash helmet. Here, helmet 500 includes shell 502, pad 504, cheekpad 506, power cell 508, electrical leads 510, connector 512, output leads 514, and light 516. Here pad 504, which, in some embodiments, may be similar to pad 402 described above in connection with FIG. 4, may be inserted into helmet 500 and shell 502 as shown. Power cell 508, electrical leads 510, connector 512, output leads 514, and light 516 may be configured in helmet 500 as shown. If a half or three-quarters (i.e., the helmet varies in the length of coverage or protection offered to the wearer) helmet is used, light 516 may be slightly recessed into the side lining of shell 502, providing a housed light that is under shell 502 but able to illuminate a field of view. Additionally, the cone of illumination provided by light 516 may also be adjusted in terms of height, angle, lateral displacement, and other factors that may provide efficient lighting for a person wearing helmet 500. In other embodiments, different or additional devices, systems, or components may be included in different positions or locations of pad 504. As an example, light 516 may be included in the left cheekpad of pad 504 while a camera may be included in the wearer's right cheekpad. In law enforcement applications, light 516 provides illumination without requiring burdensome physical activity by the user while engaging in other activities (e.g., writing on a notepad, observing or stopping a suspect while illuminating a dimly lit vehicle, and the like).

Electrical current flows from power cell 508 to light 516 and other components. In some embodiments, a camera (not shown), or other electrically powered equipment may be coupled to shell 502, pad 504 or other portions of helmet 500 without the need for an external power source. In other embodiments, additional equipment may be easily replaced by providing easily manipulated pads having pockets, fasteners, locks, or other devices used to secure equipment to pad 504.

Figure 6:
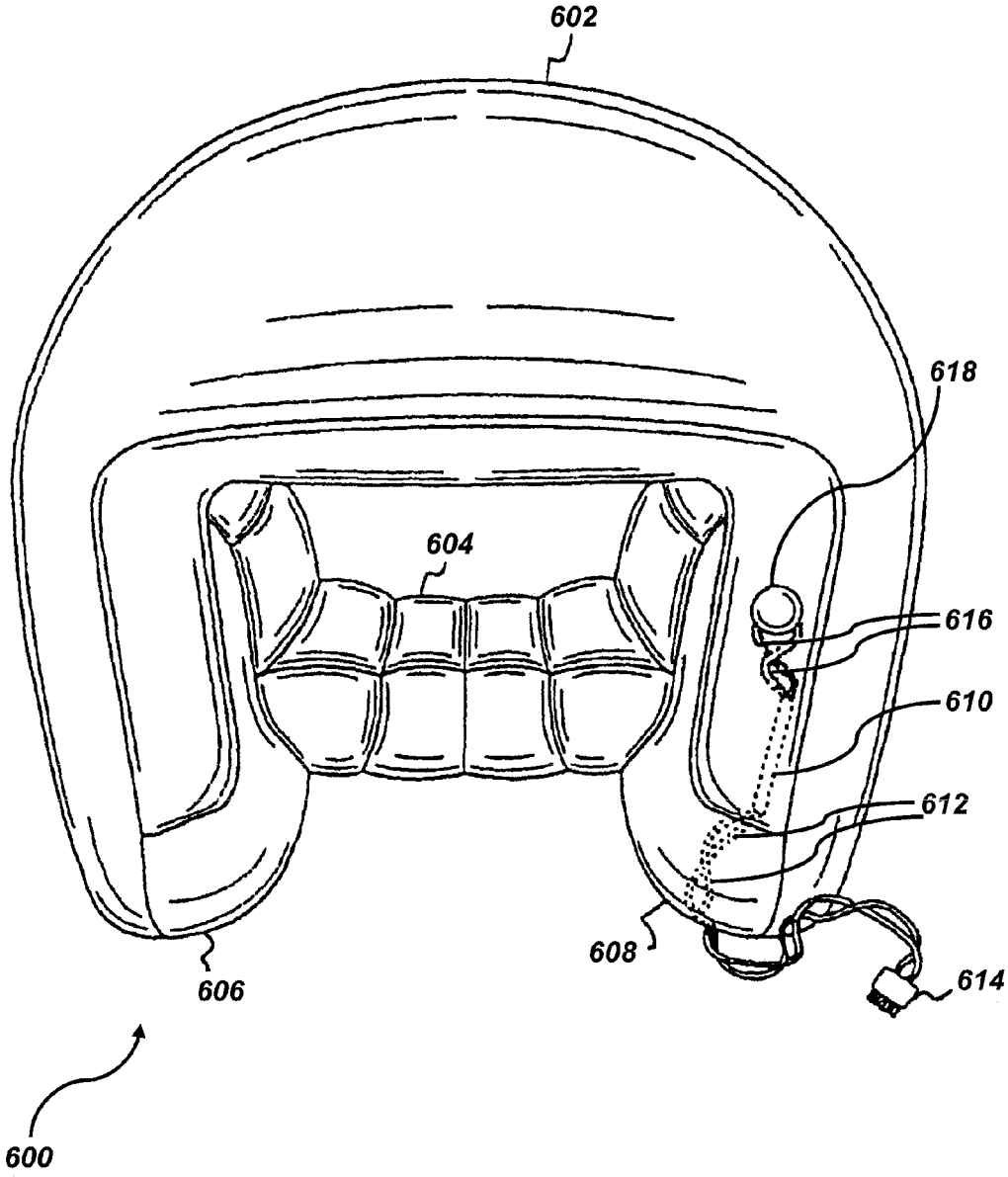
FIG. 6 illustrates another alternative exemplary electrical power system for a crash helmet.

FIG. 6 illustrates another alternative exemplary electrical power system for a crash helmet. Here, helmet 600 includes shell 602, pad 604, right cheekpad 606, left cheekpad 608, power cell 610, electrical leads 612, connector 614, output leads 616, and light 618. In some embodiments, helmet 600 may be a half or three-quarter helmet, providing an electrical power system in cheekpads or other liners such as right cheekpad 606 or left cheekpad 608. An electrical power system may be used to provide power to light 618. In other embodiments, power cell 610 may supply power via output leads 616 to other systems such as a microprocessor, wireless communications transceiver (e.g., BLUETOOTH®, or another RF transmitter), heads-up display, or other electrical or electronic system. Some or all of these systems may be included with helmet 600, which provides electrical power to various systems from power cell 610, which is formed or placed within an internal structure (e.g., left cheekpad 608) of helmet 600. In additional embodiments, a switch (not shown) may be incorporated which provides a user with the ability to open or close an electrical path to supply power to an electrically connected or coupled system (e.g., light 618). Other variations may be provided and are not limited to the embodiments described above.

Figure 7:
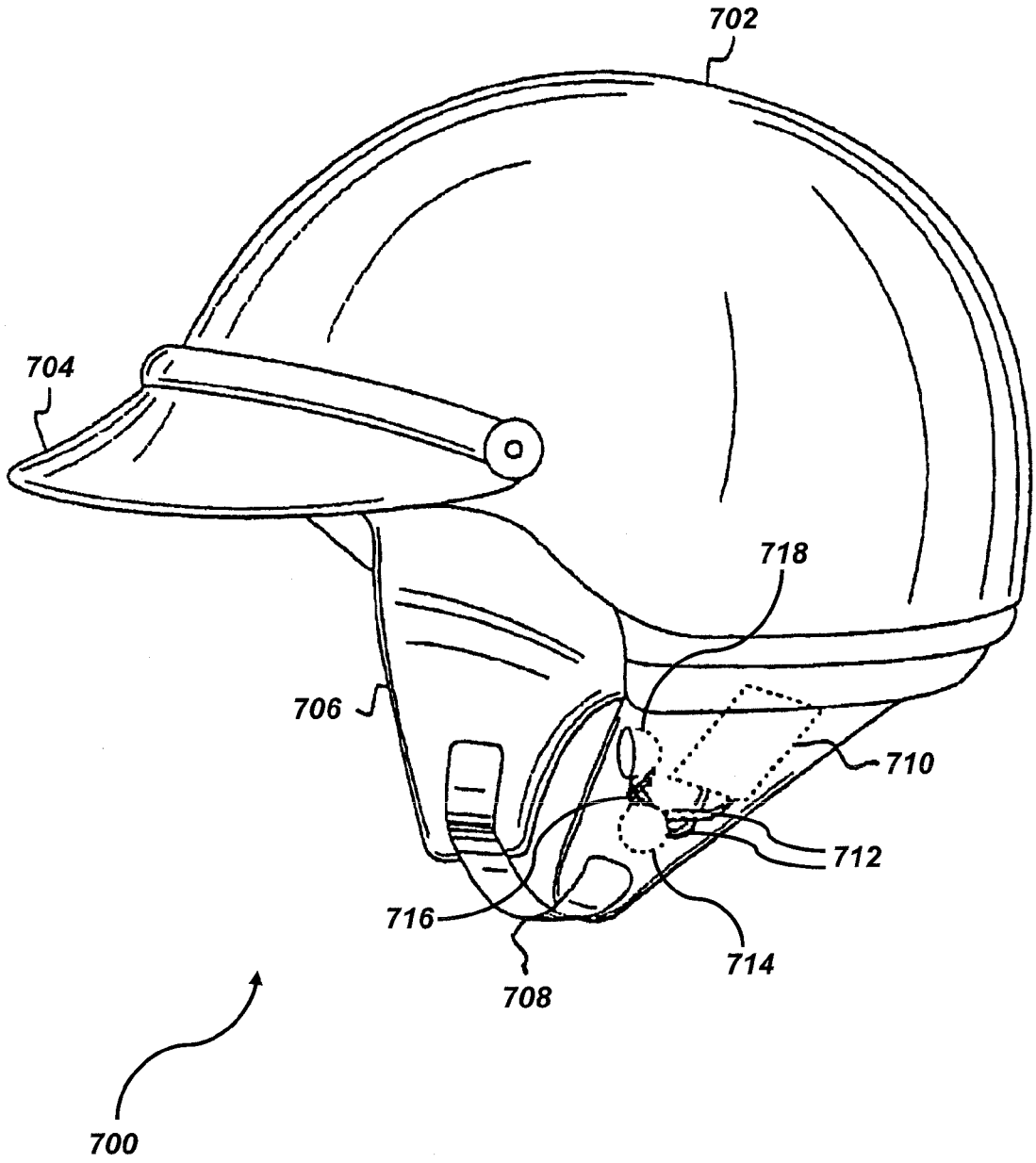
FIG. 7 illustrates another alternative exemplary helmet electrical power system.

FIG. 7 illustrates another alternative exemplary helmet electrical power system. In some embodiments, helmet 700 includes shell 702, peak 704, neck curtain 706, strap 708, power cell 710, electrical leads 712, switch 714, output leads 716, and light 718. As an example, helmet 700 may be a law enforcement helmet worn such as that worn by a police officer. An electrical power system for helmet 700 may be installed in neck curtain 706. In some embodiments, the electrical power system including, at least, power cell 710, switch 714, electrical leads 712, and output leads 714, may be implemented as part of neck curtain 706. Here, the left side of neck curtain 706 includes power cell 710, switch 714, electrical leads 712, and output leads 714. However, in other embodiments, more or fewer components may be included. For example, in addition to light 718, a camera or imaging device may be included. A microprocessor, heads-up display, or other electrical component may be used, providing additional functionality installed in helmet 700 without requiring the use of external systems. In the context of law enforcement applications, having systems such as power cell 710, switch 714, electrical leads 712, and output leads 716, internal electrical distribution provides for ease of use and frees the hands of the wearer to engage in other activities such as handling different equipment while providing illumination from the helmet at approximately the user's eye level. In some embodiments, light 718, which may be set at eye level, provides for direct or indirect illumination at a convenient height and direction for the user. As a user moves, turns, or directs his/her vision, light 718 illuminates the field of view for the user without requiring the user to direct or handle an external light, flashlight, or illumination source. This may also be useful in contexts in addition to law enforcement aspects, including military, emergency services, and basic vehicle (e.g., motorcycle) operator safety. In other embodiments, some or all of power cell 710, switch 714, electrical leads 712, and output leads 716 may be implemented in a different part of helmet 700 (e.g., right side of neck curtain 706) and are not limited to the embodiment shown.

Other embodiments may include additional or fewer components with the electrical power system that at least includes power cell 710, switch 714, electrical leads 712, and output leads 716. For example, power cell 710 may be implemented as a single electrical storage cell device or as a multiple cell storage device (e.g., battery) for electrical power. In still other embodiments, some or all of power cell 710, switch 714, electrical leads 712, and output leads 716 may be implemented in a liner, cranial pad, or other internal structure within shell 702, providing an alternative location other than neck curtain 708. Power cell 710, switch 714, electrical leads 712, and output leads 716 may be located within, for example, peak 704 or another related structure of helmet 700.

Figure 8:
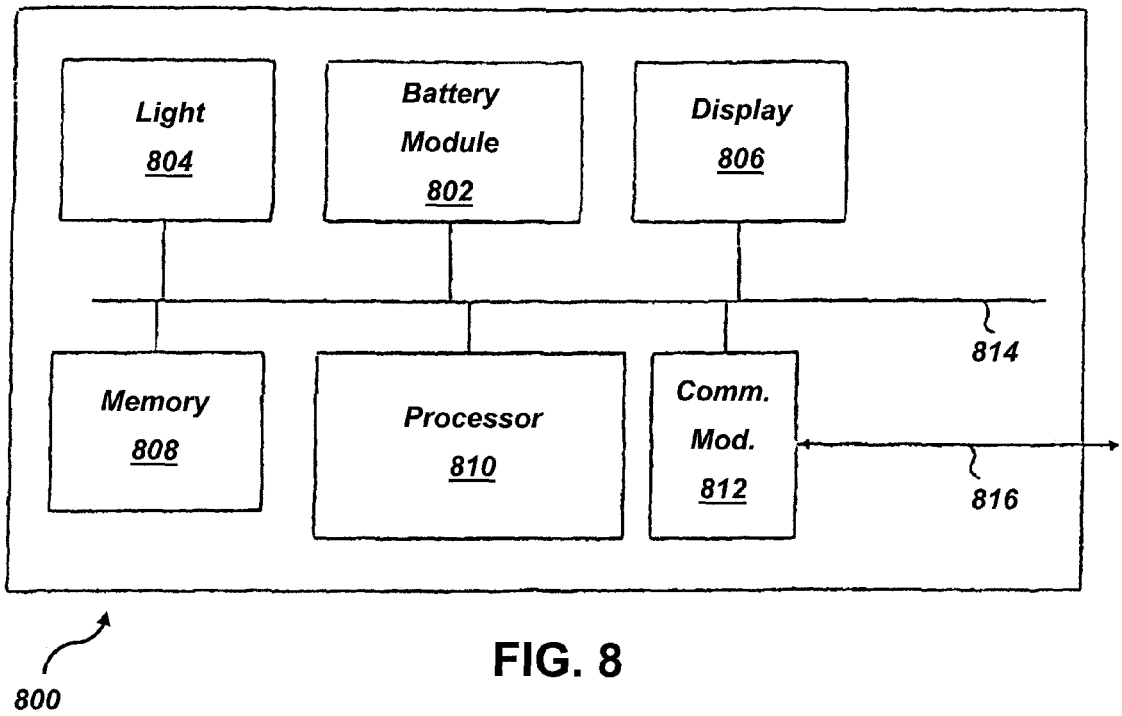
FIG. 8 is a block diagram illustrating an exemplary helmet electrical power system.

FIG. 8 is a block diagram illustrating an exemplary helmet electrical power system. In some embodiments, system 800 may include a battery module 802, light 804, display 806, memory 808, processor 810, communications module 812, electrical bus 814, and communications signal 816. Here, battery module 802 may also include logic for controlling electrical power distribution to other components in system 800. Battery module 802 may also provide an AC or DC power to other components in system 800. In other embodiments, there may be more, fewer, or different components other than those shown in system 800.

The components shown in system 800 may be implemented using various techniques and equipment. For example, light 804 may be implemented using a light emitting diode (LED), fluorescent, incandescent, or other type of bulb. In other embodiments, battery module 802 may be implemented using a single or multiple cell battery. In some embodiments, lithium ion, nickel-metal-hydride, or other fuel cell technologies may be used for battery module 802. In other embodiments, display 806 may be implemented using a simple back-lit display, a heads-up display, an electrophoretic display, a display built into a visor, or other variations as may be envisioned. In other embodiments, processor 810 may be implemented using a microprocessor (e.g., 32-bit, 64-bit, and others) for processing control signals to control various components in system 800, including memory 808. For memory 808, various implementations may be used to provide data storage for various purposes such as power settings to extend or shorten the duration of use for battery module 802, predetermined settings for display 806, light 804 (e.g., light 804 may be pre-programmed using a program stored in memory 808 and controlled by processor 810 to determine a particular time of day or night as to when light 804 is activated), and others. In other embodiments, processor 810 may process control signals with communications module 812, which may be implemented using various types of wireless (e.g., RF) communications systems for either short-range (e.g., motorcycle-to-motorcycle, unit-to-unit), cellular, or other mobile communications. In some embodiments, systems installed on a motorcycle may be activated or deactivated by control signals sent from processor 810 over communications module 812. In some embodiments, control programs stored in memory 808 may be used to control functions such as activating a motorcycle headlamp when a low-level light environment is detected. Power from battery module 802 distributed over system 800 provides flexible, safe, and efficient power distribution.

Figure 9:
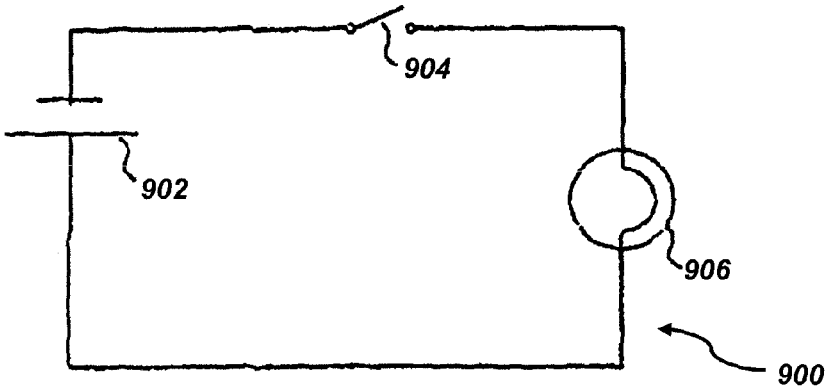
FIG. 9 is a circuit diagram illustrating an exemplary helmet electrical power system circuit.

FIG. 9 is a circuit diagram illustrating an exemplary helmet electrical power system circuit. Here, circuit 900 includes power cell 902, switch 904, and lamp 906. Lamp 906 may be activated or deactivated by closing or opening, respectively, switch 904. In some embodiments, other circuit components may be included and circuit 900 may be implemented differently, including various circuit elements or components added in either series or parallel configurations. In other embodiments, switch 904 may be coupled to a wireless transceiver (not shown) that enables remote activation and deactivation of electrical current to one, some or all circuit elements.

Figure 10:
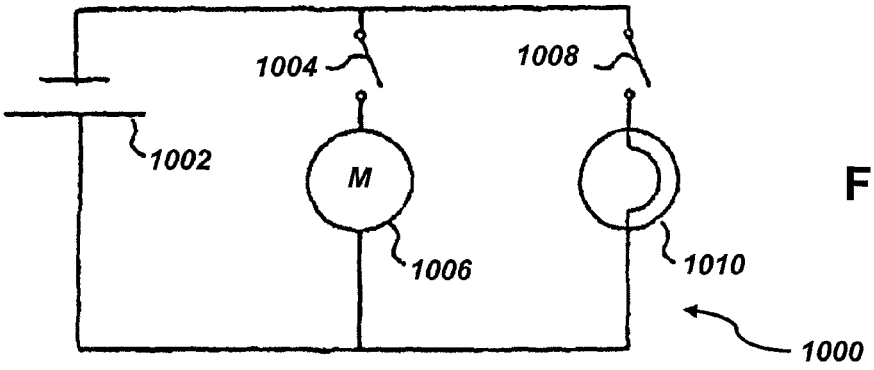
FIG. 10 is a circuit diagram illustrating an alternative exemplary helmet electrical power system circuit.

FIG. 10 is a circuit diagram illustrating an alternative exemplary helmet electrical power system circuit. In some embodiments, circuit 1000 includes power cell 1002, motor switch 1004, motor 1006, lamp switch 1008, and lamp 1010. Here, motor 1006 may be activated or deactivated by closing or opening, respectively, motor switch 1004. Likewise, lamp 1010 may be activated or deactivated by closing or opening, respectively, lamp switch 1008. In some embodiments, other circuit components may be included and circuit 1000 may be implemented differently, including various components in either series or parallel configurations. In other embodiments, motor switch 1004 may be coupled to a wireless transceiver (not shown) that enables remote activation and deactivation of electrical current to one, some or all circuit elements. In the above embodiments, variations may be performed to enable local or remote control, using direct or indirect means (e.g., wireless RF transceivers) for sending control signals to activate or deactivate a switch (e.g., switch 904, motor switch 1004) or other elements of electrical power systems for helmets. Different circuit configurations may be implemented by modifying some or all of the circuit elements shown and described above. Various implementations may be used and electrical circuit configurations are not limited to those embodiments described above.

Figure 11A:
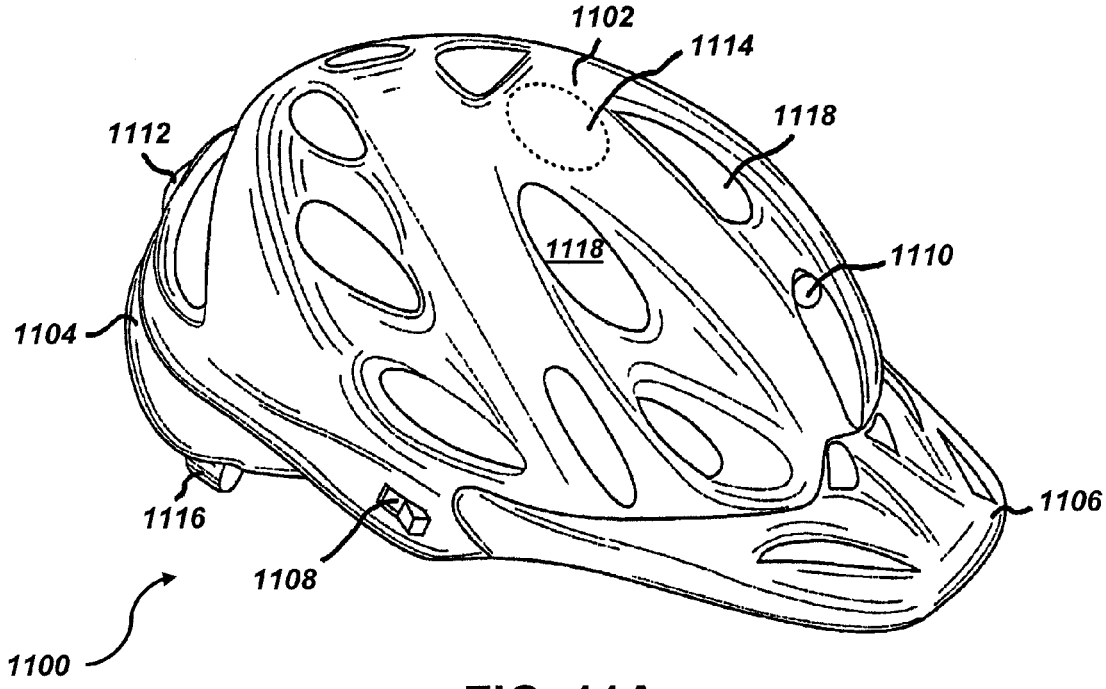
FIG. 11A illustrates an alternative exemplary power system for a bicycle helmet.

FIG. 11A illustrates an alternative exemplary power system for a bicycle helmet. Here, helmet 1100 includes shell 1102, foam element 1104, visor 1106, switch 1108, lights 1110 and 1112, battery 1114, chinstrap 1116, and vents 1118. In some embodiments, helmet 1100 may include an electrical system, such as those described above, for uses within recreational or working bicycle helmets for various uses, including racing, recreation, athletic competition, riding, law enforcement, child safety, public safety, and others. Electrical power systems such as those described above may be used in any type of helmet and are neither restricted nor limited to those shown. Mining, construction, military, law enforcement, recreation, athletic competition, mountaineering, rock climbing, and other types of helmets may have electrical power systems such as those described.

Here, battery 1114 may be housed within helmet 1100. In some examples, battery 1114 may be housed within a cavity, hole, housing, or other structure formed within foam element 1104. In some embodiments, foam element 1104 may be formed using expanded polystyrene (EPS), expanded polypropylene (EPP), GECET® foam as developed by GENERAL ELECTRIC®, expanded polyurethane, TAU® multi-impact (i.e., re-up foam), and other forms of beaded or unbeaded materials that are used to form crushable materials that, when impacted, convert impact energy to heat energy, thus slowing an impact and distributing force while protecting a wearer of helmet 100. As an example, if foam element 1104 is formed using EPS, a housing may be formed to allow battery 1114 to be inserted into the housing and shell 1102 may be coupled (i.e., using glue, tape, VELCRO®, or other adhesive materials) together. In some embodiments, helmets may be formed using shell 1102 that holds various elements of an electrical power system (e.g., wires, circuits, battery 1114, processor, and others) and, when shell 1102 is coupled to foam element 1104, an integral system is formed, such as helmet 1100. Electrical power may be provided by operating switch 1108, which enables current to flow from battery 1114 to lights 1110 and 1112. In other examples, different elements may be coupled to helmet 1100. For example, a BLUETOOTH® communications module may be coupled to an electrical distribution system within helmet 1100, thus allowing the wearer (i.e., rider) to use a mobile phone while riding his/her bicycle, thus allowing hands-free use to ensure rider safety. Thus, distribution of electrical power and current may be provided, allowing a wearer to employ various types of devices that provide light, communication, information (e.g., heads-up displays), and other features. In other embodiments, helmet 1110 may be implemented differently and is not limited to the examples shown and described. Various types, sizes, and shapes of bicycle helmets may be used and are not intended to be limited to any particular set of dimensions or manufacturer.

Figure 11B:
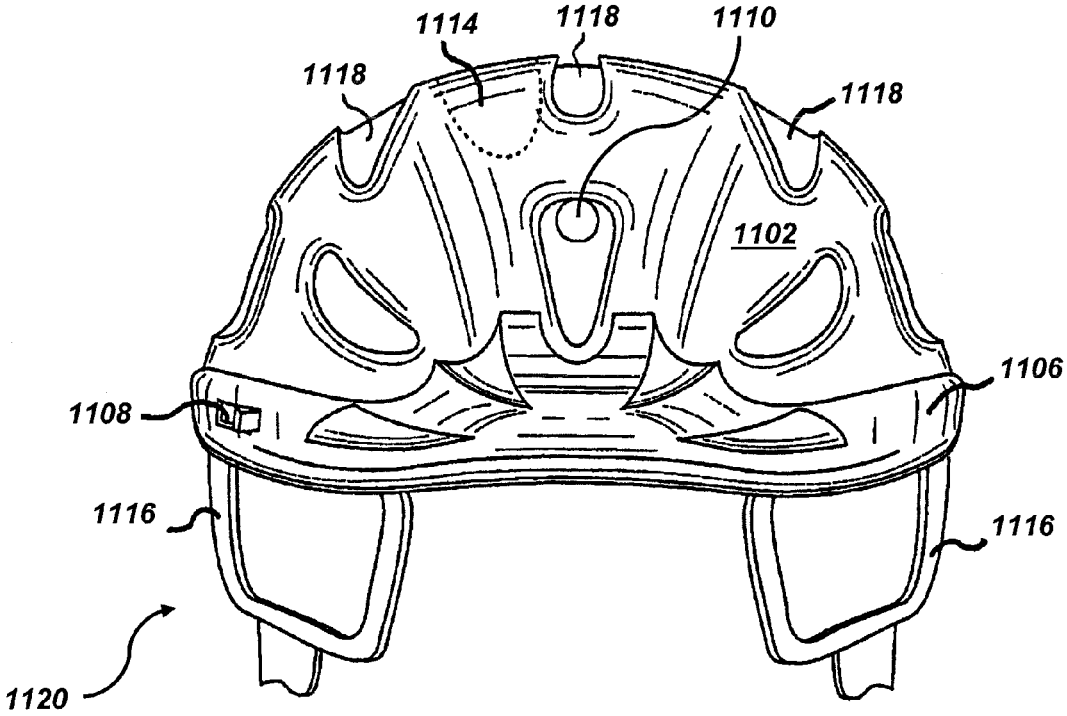
FIG. 11B is a frontal view of an alternative exemplary power system for a bicycle helmet.

FIG. 11B is a frontal view of an alternative exemplary power system for a bicycle helmet. Here, a frontal view of helmet 1120 is shown, which may be similar to helmet 1100 illustrated and described above in connection with FIG. 11A. Helmet 1120 includes shell 1102, visor 1106, switch 1108, light 1110, battery 1114, chinstrap 1116, and vents 1118. Battery 1114 may be housed within a cavity or other enclosure formed within foam element 1104 (FIG. 11A; not shown in FIG. 11B) and, when switch 1108 is operated, current is allowed to flow to elements such as light 1110. In some embodiments, battery 1114 may be placed off-center (i.e., either side of the lateral center axis of helmet 1120) in order to prevent impeding air flow through vents 1118. Further, the contour of helmet 1120 may be designed to redistribute energy from an impact and, by placing battery 1114 in a housing between vents 1118, the safety design and configuration of helmet 1110 is not weakened. In other words, by placing battery 1114 within a cavity of foam element 1114 and then sealed by coupling shell 1102 to foam element 1114, the structural integrity of helmet 1120 is maintained. Further, by using a rechargeable, flat battery or power cell, such as those described above, minimal weight is added and the impact to the wearer does not impact the performance of the rider due to weight considerations. In other embodiments, the above-described elements, features, and functions of helmet 1120 may be implemented differently and are not limited to the examples provided.

Figure 12:
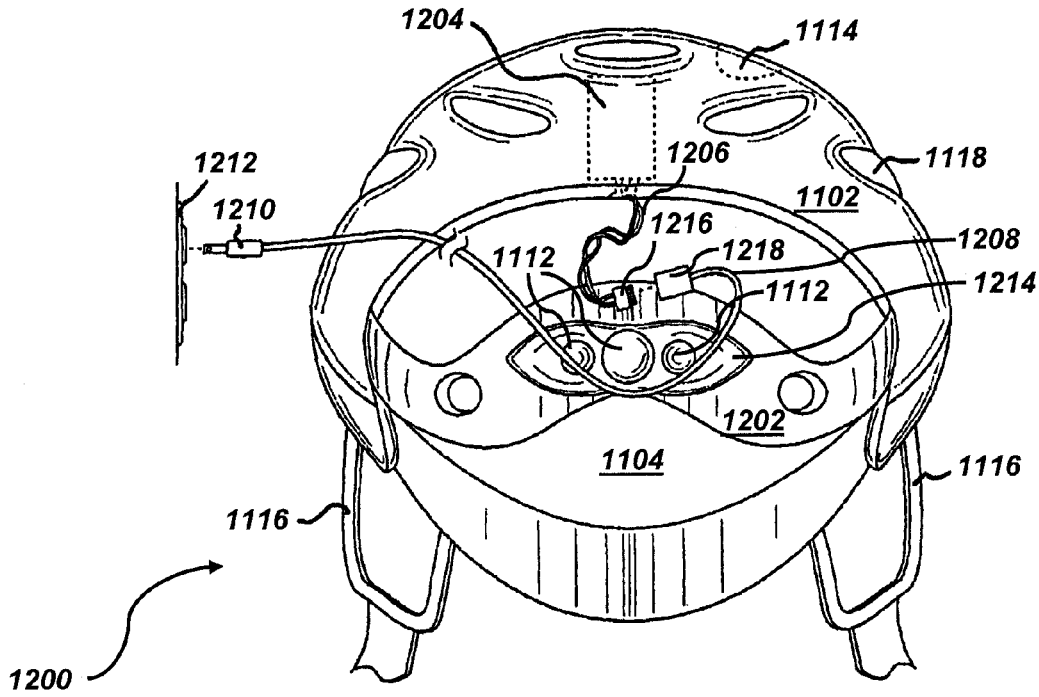
FIG. 12 is a rear view of an alternative exemplary power system for a bicycle helmet.

FIG. 12 is a rear view of an alternative exemplary power system for a bicycle helmet. Here, system 1200 includes shell 1102, foam element 1104, lights 1112, battery 1114, chinstraps 1116, vents 1118, rear support 1202, alternative battery 1204, wires 1206, charging cable 1208, charging plug 1210 (which may be plugged directly or indirectly into wall outlet 1212), light mount 1214, male coupling 1216, and female coupling 1218. In some embodiments, battery 1114 may be implemented using alternative battery 1204, which is shown with placed in a housing formed in foam element 1104 and under shell 1102. When male coupling 1216 is coupled to female coupling 1218, battery 1204 or battery 1114 may be recharged using current provided from wall outlet 1212 via charging plug 1210. Once charged, male coupling 1216 may be uncoupled from female coupling 1218, allowing wires 1206 to be secured between shell 1102 and foam element 1104. In other embodiments, wires 1206 may be secured using a pocket, channel, adhesive, VELCRO®, strap, or the like. Various alternatives for securing wires 1206 may be used and are not limited to the examples provided. Once uncoupled from charging cable 1208, helmet 1200 may be used and worn, providing electrical power and current to lights (e.g., incandescent, light emitting diodes (LED), or other types of bulbs), which provide rear safety lights to motorists and others approaching the wearer. Further, different types and techniques for charging battery 1114 or battery 1204 may be used and are not limited to the example shown. In other embodiments, helmet 1200 may be implemented differently and is not limited to the design, function, structure, or materials of the examples shown and described.

Figure 13:
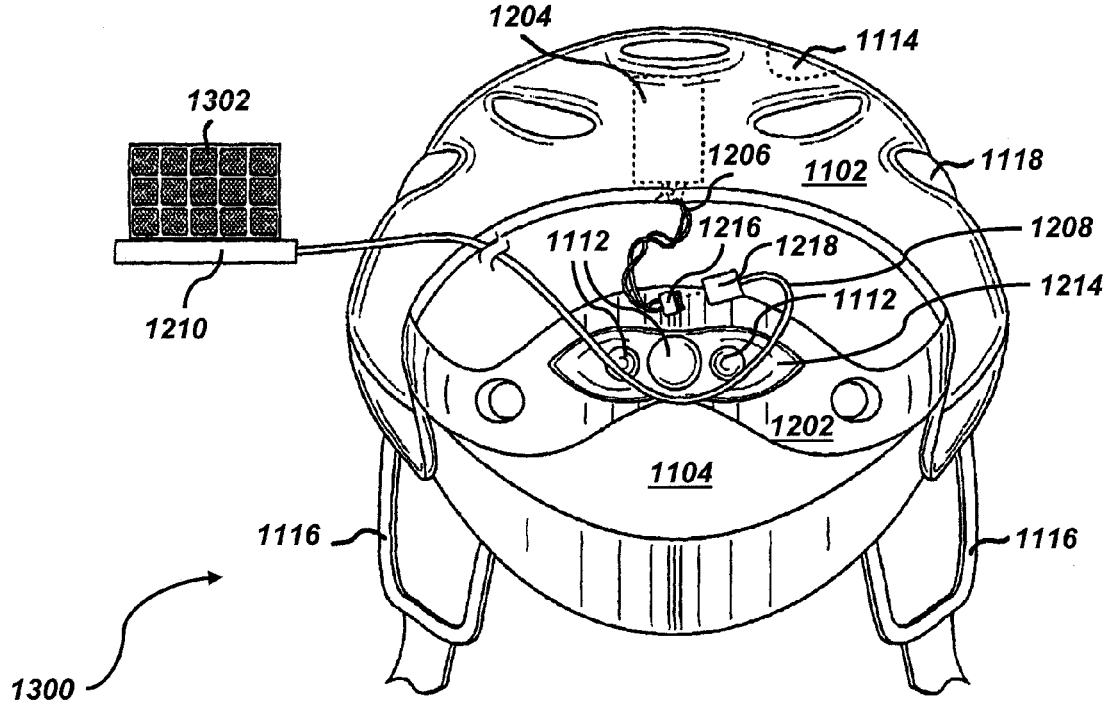
FIG. 13 is an alternative rear view of an alternative exemplary power system for a bicycle helmet.

FIG. 13 is an alternative rear view of an alternative exemplary power system for a bicycle helmet. Here, helmet 1300 includes shell 1102, foam element 1104, lights 1112, battery 1114, chinstraps 1116, vents 1118, rear support 1202, alternative battery 1204, wires 1206, charging cable 1208, charging plug 1210, light mount 1214, male coupling 1216, and female coupling 1218. In some embodiments, battery 1114 or battery 1204 may be recharged using solar cell 1302. By attaching male coupling 1216 to female coupling 1218, electrical power and current may be generated by photovoltaic cell 1302 that captures and converts light to electricity for storage in battery 1114 or alternative battery 1204. Once stored, electricity may be distributed to other elements of helmet 1300, including lights 1112. In other embodiments, a matrix of solar (i.e., photovoltaic) cells may be used, allowing greater and faster recharging abilities for recharging battery 1114 and battery 1204. In other examples, helmet 1300 may be implemented differently and is not limited to the examples, functions, structure, or other features shown.

Figure 14:
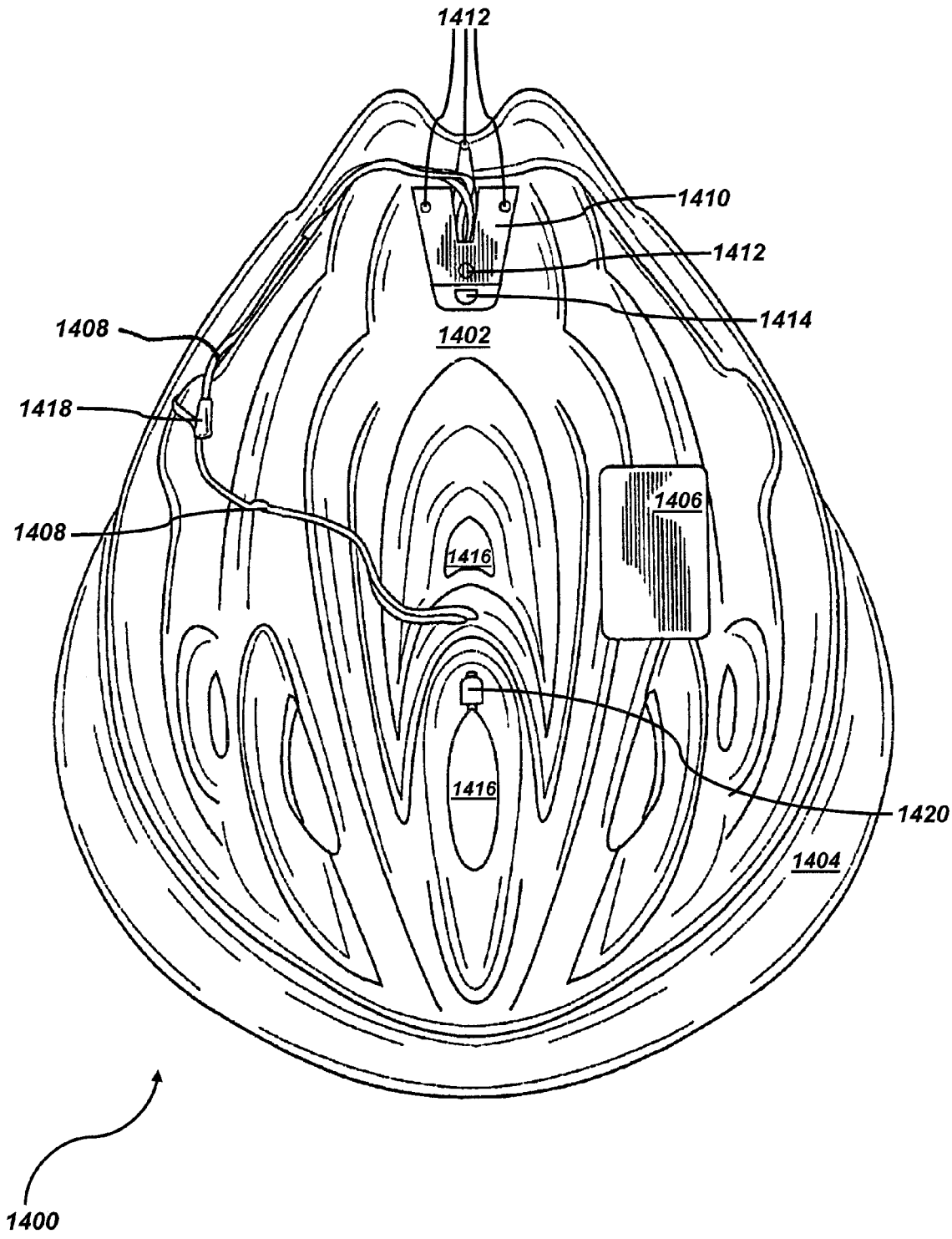
FIG. 14 is a bottom view of an alternative exemplary power system for a bicycle helmet.

FIG. 14 is a bottom view of an alternative exemplary power system for a bicycle helmet. Here, helmet 1400 includes shell 1402, visor 1404, battery 1406, wire 1408, light mount 1410, posts 1412, light mount 1414, vents 1416, charging cable coupling 1418, and light 1420. In some embodiments, shell 1402 may be coupled or attached to a foam element (not shown). When coupled using glue, tape, VELCRO®, or any other type of adhesive material, battery 1406 is fit within a housing (e.g., insert, hole, cavity, or other formed opening in foam element 1104 (FIGS. 11A, 11B, 12, and 13). Further, a channel (e.g., groove, shallow trench, or the like) may be formed to also house wiring 1408, which may also be "tucked" or inserted into a channel within a foam element. Once mated, shell 1402 forms a complete helmet, such as those described above in connection with FIGS. 11A, 11B, 12, and 13. When worn, helmet 1400 may provide electrical current to light 1420 that, when powered by battery 1406, provides illumination for a wearer while riding a bicycle. Further, the above-described embodiments are examples of how an electrical distribution system may be formed into a helmet for various types of purposes and used to provide features such as lighting, communications, and information. In other embodiments, different designs, structures, materials, or features may be implemented and are not limited to the examples shown and described.

Although the foregoing embodiments have been described in some detail for purposes of clarity of understanding, the invention is not limited to the details provided. There are many alternative ways of implementing the invention. The disclosed embodiments are illustrative and not restrictive.

What is claimed:

1. An electrical system for a bicycle helmet, comprising:

a battery configured to provide an electrical current;

an electrical distribution system configured to provide a current path between the battery and one or more elements;

a processor configured to provide one or more control signals to control distribution of electrical power using the electrical distribution system; and a housing configured to house the battery and a channel configured to house one or more circuits of at least one of at least a portion of the electrical distribution system and the one or more elements, wherein the housing is a cavity within a foam element configured to provide an inner lining to the bicycle helmet, the battery is disposed within the housing and the cavity is sealed from access by adhesive coupling of a shell of the bicycle helmet to the foam element.

2. The electrical system of claim 1, wherein the electrical system is coupled to the bicycle helmet.

3. The electrical system of claim 1, wherein the electrical system is integrated with the bicycle helmet.

4. The electrical system of claim 1, wherein the battery is rechargeable.

5. The electrical system of claim 1, wherein the bicycle helmet includes a light, the light being coupled to the bicycle helmet.

6. The electrical system of claim 5, wherein the light is a light emitting diode.

7. The electrical system of claim 1, further comprising a communications system.

8. The electrical system of claim 7, wherein the communications system is in data communication with a cell phone.

9. The electrical system of claim 7, wherein the communications system includes a BLUETOOTH® module.

10. The electrical system of claim 7, wherein the communications system is configured to transmit and receive a RF signal.

11. The electrical system of claim 1, wherein the channel is formed within the foam element.

12. The electrical system of claim 1, wherein the battery is rechargeable using solar energy.

13. The electrical system of claim 12, wherein the battery is rechargeable using AC or DC.

14. An electrical power system disposed in a bicycle helmet, comprising:

a battery housed within a first structure comprising an element of a bicycle helmet, wherein the battery is sealed within a housing by coupling the first structure substantially within an interior of a second structure, the first structure being configured to provide an inner lining of the second structure, and the housing being a cavity formed within the first structure, the housing being sealed by adhesive coupling of the first structure to a surface on the interior of the second structure;

a processor configured to provide one or more control signals to control distribution of electrical power using an electrical distribution system; and a circuit disposed in a channel formed in the element of the bicycle helmet and coupled to another element of the bicycle helmet, the circuit having a coupling configured to recharge the battery.

15. An electrical system disposed in a bicycle helmet, comprising:

a distribution system configured to supply electrical power to a bicycle helmet system;

a power source configured to supply power to one or more elements associated with the bicycle helmet system using the distribution system, the power source being housed within a cavity of material of a protective element of the bicycle helmet, and sealed in the cavity without access by the protective element being mated to the interior of a shell of the bicycle helmet; and a processor configured to provide one or more control signals to control distribution of electrical power from the power source to the one or more elements using the distribution system.

16. The electrical system of claim 15, wherein the protective element is a foam element of the bicycle helmet.

17. The electrical system of claim 15, wherein the protective element is a chinbar of the bicycle helmet.

* * * * *

UNITED STATES PATENT AND TRADEMARK OFFICE

CERTIFICATE OF CORRECTION

PATENT NO. : 7,905,620 B2
APPLICATION NO. : 11/527788
DATED : March 15, 2011
INVENTOR(S) : Kerry Harris It is certified that error appears in the above-identified patent and that said Letters Patent is hereby corrected as shown below:

On the title page:
In ITEM (56) References Cited
OTHER PUBLICATIONS
Page 1, 2nd column,

*Primary Examiner* change "Sandra L. O Shea" to --Sandra L. O'Shea--

Signed and Sealed this
Twelfth Day of February, 2013

Teresa Stanek Rea
*Acting Director of the United States Patent and Trademark Office*